US006402893B2

(12) United States Patent
Lumiala et al.

(10) Patent No.: US 6,402,893 B2
(45) Date of Patent: Jun. 11, 2002

(54) CONTROL EQUIPMENT FOR THE HEADBOX TIP LATH IN A PAPER MACHINE OR SUCH AND METHOD OF TIP LATH CONTROL

(75) Inventors: Juhana Lumiala; Jarmo Kirvesmäki; Kari Pitkäjärvi; Tommi Korolainen, all of Jyväskylä; Ilkka Kemiläinen, Leppävesi, all of (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/791,302

(22) Filed: Feb. 23, 2001

(30) Foreign Application Priority Data

Mar. 3, 2000 (FI) ..... 20000495

(51) Int. Cl.[7] ..... D21F 1/02
(52) U.S. Cl. ..... 162/259; 162/347
(58) Field of Search ..... 162/198, 212, 162/216, 252, 259, 262, 263, 315, 336, 344, 345, 346, 347, 317; 700/127, 128, 129

(56) References Cited

U.S. PATENT DOCUMENTS 2,325,016 A * 7/1943 Warren ..... 162/347
2,779,253 A * 1/1957 Owens ..... 162/344
3,334,011 A * 8/1967 Gedemer et al. ..... 162/347
4,783,241 A * 11/1988 Egelhof et al. ..... 162/347
5,019,216 A * 5/1991 Segalla et al. ..... 162/344

FOREIGN PATENT DOCUMENTS

EP 0 290 367 * 4/1988 ..... D21F/1/02

* cited by examiner

*Primary Examiner*—Peter Chin
*Assistant Examiner*—Eric Hug
(74) *Attorney, Agent, or Firm*—Lathrop & Clark LLP

(57) ABSTRACT

Control equipment for the headbox tip lath of a paper machine includes first actuators (12$a_1$, 12$a_2$ . . . ), which are located at different points along the headbox (100) width and connect functionally with a bendable intermediate part (14). At the different points along the headbox (100) width there are also second actuators (13$a_1$, 13$a_2$ . . . ) which are used in the tip lath control. These connect functionally with both the bendable intermediate part (14) and the tip lath (11). The first actuators (12$a_1$, 12$a_2$ . . . ) are used to perform rough control of the tip lath (11) whereas the second actuators (13$a_1$, 13$a_2$ . . . ) are used to perform fine control of the tip lath (11).

20 Claims, 5 Drawing Sheets

CONTROL EQUIPMENT FOR THE HEADBOX TIP LATH IN A PAPER MACHINE OR SUCH AND METHOD OF TIP LATH CONTROL

CROSS REFERENCES TO RELATED APPLICATIONS

This application claims priority on Finnish Application No. 20000495, Filed Mar. 3, 2000, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention concerns control equipment for the headbox tip lath in a paper machine or such and a method for controlling the tip lath.

Traditionally, controlling of the headbox in Z and CD directions has been done by using two separate control mechanisms. Controlling over the whole slice width in the Z direction has been done by opening the top lip articulated to the frame. On the other hand, profiling in the CD direction has been done by bending the continuous tip lath by control spindles located at approximately 100 mm intervals.

Controlling in the Z direction of the lip slice is mainly needed in grade changes. However, performed research shows that there is no great need of control in the Z direction. At dilution headboxes CD control of the slice has mainly been used for zeroing of the lip before the start and in some cases for optimising the fiber orientation.

SUMMARY OF THE INVENTION

The inventive idea is to divide the traditional tip lath control into two separate control steps: into fine and rough control respectively. Hereby lip zeroing may be done before the start by using fine control, whereas the rough control may be used for doing a sufficient total lip slice control as well as orientation profiling in the CD direction on a larger scale.

The solution allows omitting the joint between the top lip and the top frame, whereby the top lip can be integrated directly into the top frame. In this way the headbox structure is made considerably steadier and simpler. In present day headboxes, the lip slice is controlled by turning the top lip beam with the aid of worm gear reducers around a joint located at the back edge of the top lip beam. Forces applying to the control spindles of the tip lath and to their driving gears become strong due to the large pressure surface area of the top lip beam. The internal headbox pressure is directly proportional to the running speed square, whereby in new high-speed machines structures can no longer be made durable or possible structural solutions are heavy and expensive. In a two-step tip lath control, where the top lip beam of the headbox is fixed, only the pressurized bottom edge of the tip lath will bring about loading of gears and spindles. Hereby the necessary supporting forces also remain small. According to preliminary estimates, considerable savings are achieved in mechanical manufacturing costs in the case of a full-width headbox. On the other hand, strengthening of the framework allows increasing the headbox speed.

In the solution, the tip lath is zeroed by such second actuators attached to the lath, which may be fine control spindles (with a division of e.g. about 100 mm). In each control spindle there is an own independent spindle length control gear $V_1$, $V_2$ . . . The gear may be e.g. an advantageous turnbuckle screw mechanism. Since usually the headbox lip needs zeroing only once during the useful life of the headbox, a motor is not necessarily needed in the fine control. All fine control spindles are attached directly or by intermediate parts at one end to an intermediate part extending over the headbox width, preferably to a beam, which for its part can be moved and bent by rougher first actuators, that is, by rough control actuators located with a division of e.g. 1000 mm CD. The beam is supported in such a way in the frame that it can bend and move in the control direction only. The beam must be so strong that it is able without bending to carry all loads arriving from the tip lath and the fine control spindles. Correspondingly, the rough control actuators must be so strong that they can be used for controlling the lip slice in the Z direction and for bending the beam extending through the machine in this way to control the fiber orientation in the CD direction.

Using the solution it is possible to correct an orientation profile error at a sufficient level using a smaller number of actuators and automation cards. With a full-width machine, this means a saving in actuators and automation as well as a considerably speedier control.

With the proposed solution it is possible to implement a lip slice control that will not change the discharge angle of departure. Thus, the headbox need no longer be tilted to direct the discharge into the jaw between wires when modifying the lip slice size. Correspondingly, horizontal transfer of the top lip is also eliminated.

This application thus proposes a two-step tip lath control for use, whereby two actuators are used, first actuators and second actuators, which are located functionally after one another in a mutual series. The first actuators affect a bent intermediate part, for example, a beam structure, and with the aid of the said first actuators rough control of the tip lath is performed and e.g. the fiber orientation profile is affected. The second actuators may simply be fine control spindles and they are located with a closer division after the first actuators affecting in between the flexible beam and the tip lath, and with the aid of these fine control of the tip lath is performed as well as e.g. zeroing of the tip lath.

Thus, as explained above, the headbox according to the invention may be used in such an application, where the top lip is not articulated, whereby no such forces are applied to the tip lath and the gearbox as in an articulated structure turning at its top lip. However, the invention is also suitable for use in such headboxes, where the top lip beam is articulated to turn.

In state-of-the-art structures, the fiber orientation control is implemented with the aid of fine control spindles located with an approximate division of 100 mm. In the structure according to the invention, the control actuators used for controlling the fiber orientation, that is, the first actuators, are located with a division of approximately 1.0 m only. Equipment thus remains small.

The control equipment for the headbox tip lath in a paper machine or board machine according to the invention and the method for tip lath control are characterised by the features presented in the claims.

In the following, the invention will be described with reference to some advantageous embodiments of the invention shown in the figures of the appended drawings, but the intention is not to limit the invention to these embodiments only.

DESCRIPTION OF THE PREFERRED EMBODIMENTS

Figure 1A:
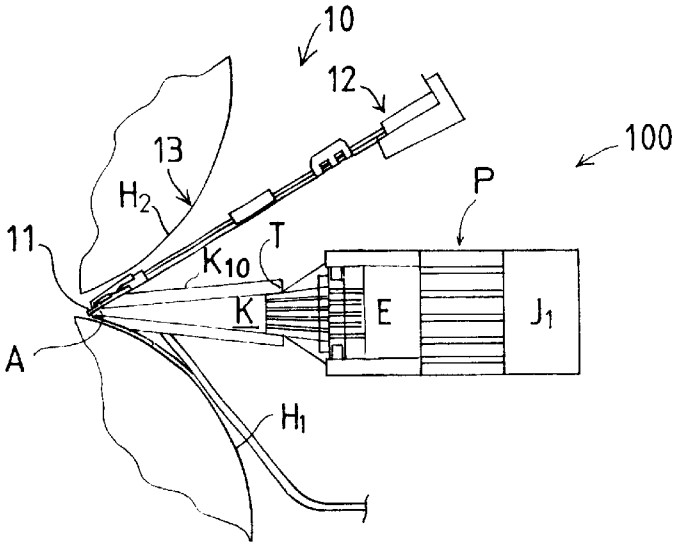
FIG. 1A is a side view of a headbox in a paper machine or board machine or such and of a tip lath control equipment according to the invention located in the headbox.

FIG. 1A shows a side view of a headbox 100 in a paper machine or board machine or such and of control equipment 10 for the tip lath 11 according to the invention. The headbox 100 shown in the figure includes a set of pipes P after a pulp distributing manifold J1, through which pipes the pulp flow is conducted to an intermediate chamber E and further by way of turbulence generator T into lip cone K and from the lip cone through lip slice A into the jaw between formation wires H1 and H2. Lip slice A is controlled by bending tip lath 11 with the aid of equipment 12*a*1, 12*a*2 . . . 14; 13*a*1, 13*a*2 . . . located on the top surface of top lip beam K10. The top lip beam K10 is fixed and includes no tilting joint for top lip beam K10. In the equipment solution according to the embodiment in FIG. 1A, tip lath 11 is moved according to the invention by two functionally series-connected actuators 12*a*1, 12*a*2 . . . and 13*a*1, 13*a*2 . . . The first actuators 12*a*1, 12*a*2 . . . are located to connect with a bendable and thus movable intermediate part 14, preferably with a beam extending over the width of headbox 100, so that the said actuators 12*a*1, l2*a*2 . . . are located between the intermediate part 14 and stop face R' of the above frame R. As shown in FIG. 1B the first actuators 12*a*1, 12*a*2 . . . include a first actuator 12*a*3 positioned in a cross machine direction spaced between two first actuators 12*a*2, 12*a*4. With the aid of the said first actuators 12*a*1, 12*a*2 . . . control of lip slice A is carried out as a rough control, and the said control is preferably used to perform correction of the fiber orientation profile. The said fist actuators 12*a*1, 12*a*2 . . . are so-called rough control actuators. Zeroing of the headbox lip and exact control of the tip lath are performed by the second actuators 13*a*1, 13*a*2 . . . , which are so-called fine control equipment functionally located to exert an effect in between the flexible beam 14 and the tip lath 11. The first actuators 12*a*1, 12*a*2 . . . are e.g. hydraulic cylinders or spindles moved by motor-gear combinations. The second actuators 13*a*1, 13*a*2 . . . are preferably fine control spindles 15*a*1, 15*a*2 manually controlled only as regards their length. Generally in this application, first actuators 12*a*1, 12*a*2 . . . are understood as being equipment which is used to bring about loading and deformation in the intermediate part 14 and further through this in the tip lath 11, whereas the second actuators 13*a*1, 13*a*2 . . . are understood as being such equipment as fine control spindles manually controlled only as regards their length, which are located with a closer division and which also affect tip lath 11, whereby with the aid of the said second actuators 13*a*1, 13*a*2 . . . the tip lath 11 can be controlled and bent into its desired shape in the fine control stage.

FIG. 1B illustrates the structure according to FIG. 1A and a function is added to its presentation, that is, the function brought about by each group of actuators 12$a_1$, 12$a_2$ . . . ; 13$a_1$, 13$a_2$ . . .

The first actuators 12$a_1$, 12$a_2$ . . . are used to affect the flexible beam 14 and give it a certain bent shape, and the beam's bent shape is transferred further to tip lath 11 through the second actuators 13$a_1$, 13$a_2$ . . . , which are e.g. fine control spindles 15$a_1$, 15$a_2$. The fine control proper is performed by the second actuators 13$a_1$, 13$a_2$ . . . , which are located between the concerned intermediate part 14, preferably a flexible beam, and tip lath 11.

The flexible and thus movable intermediate part 14 of the tip lath is a beam extending over the width of the headbox. The second actuators 13$a_1$, 13$a_2$ . . . are located with a closer division than the first actuators 12$a_1$, 12$a_2$ . . . The first actuators and second actuators 12$a_1$, 12$a_2$ . . . ; 13$a_1$, 13$a_2$ . . . are functionally in a series in relation to each other.

Figure 1C:
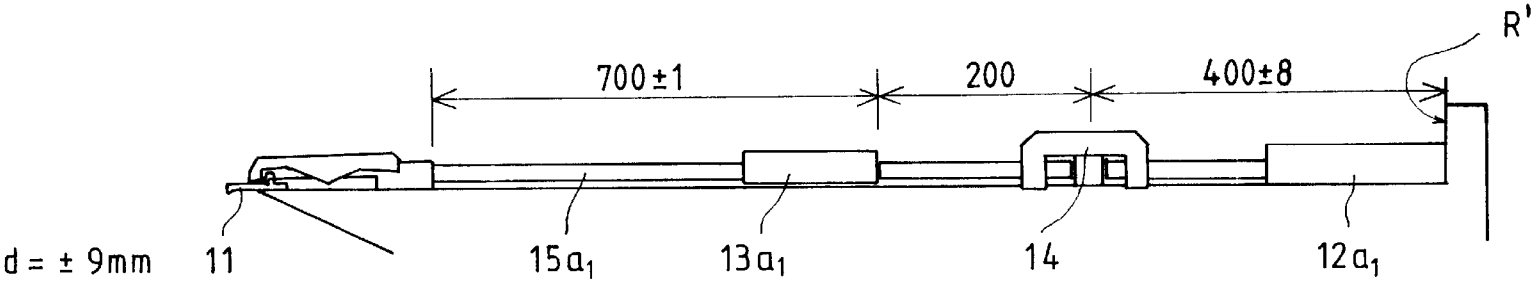
FIG. 1C shows in millimeters the magnitude of correction achieved with the different actuators.
Figure 1B:
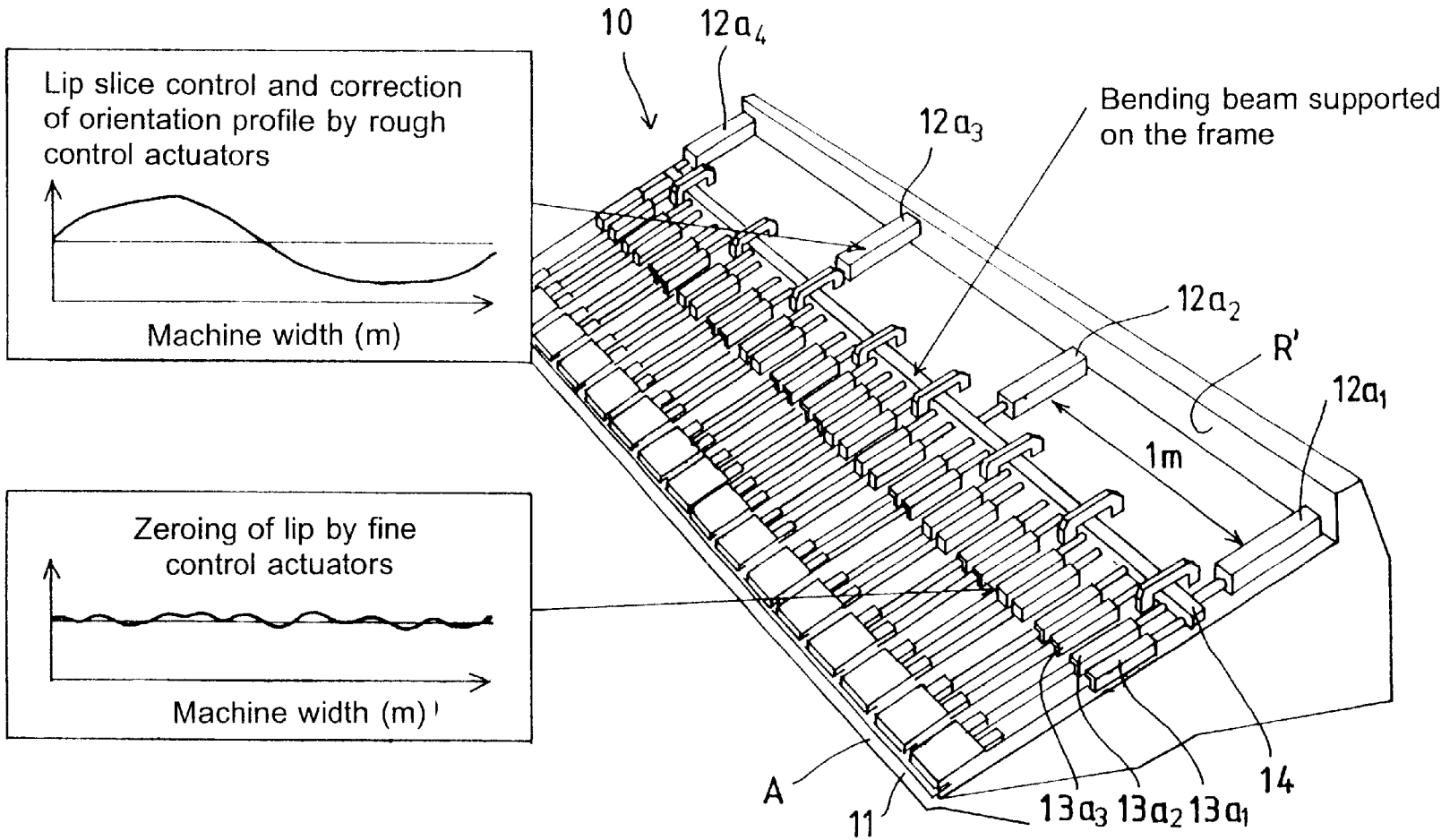
FIG. 1B illustrates the structure according to FIG. 1A and the various functions of the operation are added in the figure for each different actuator group.

FIG. 1C also shows in millimeters the magnitude of the correction brought about by the different control equipment when the total control range d is ±9 mm. The size of the correction of tip lath 11 which can be performed by the first actuators 12$a_1$, 12$a_2$ . . . is ±8 mm, while the size of the correction of tip lath 11 which can be performed by the second actuators 13$a_1$, 13$a_2$ . . . is ±1 mm.

Figure 2:
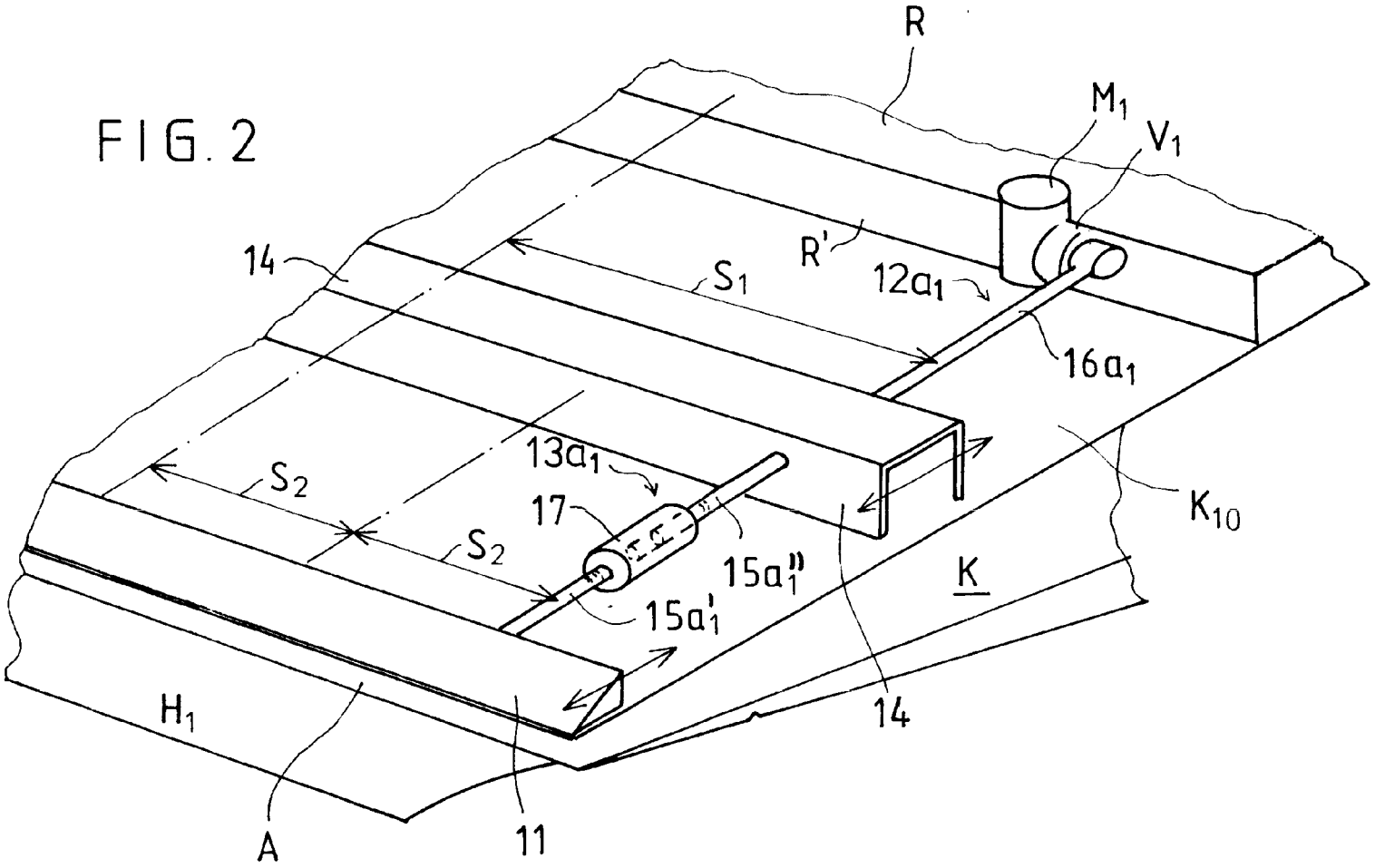
FIG. 2 illustrates the formation of the first and second actuators and their connections with the structures.

FIG. 1C illustrates an embodiment for forming the actuators 12$a_1$, 12$a_2$ . . . and 13$a_1$, 13$a_2$ . . . As is illustrated in FIG. 2, the first actuators 12$a_1$, 12$a_2$ . . . are so-called motor-gear-spindle combinations $M_1$, $V_1$, 16$a_1$, which connect in between the front face R' of frame R and the flexible and thus movable intermediate part 14, preferably a beam. Motor $M_1$, $M_2$ . . . may be an electric motor. As further illustrated in FIG. 2, located in between tip lath 11 and the beam of flexible intermediate part 14 there are second actuators 13$a_1$, 13$a_2$ . . . , so-called fine control actuators, which in the embodiment illustrated in FIG. 2 are formed by spindles 15$a_1$', 15$a_1$", which at their end threads are joined functionally to one another through a connecting internally threaded bushing 17$a_1$. By turning bushing 17$a_1$ tip lath 11, is affected between the ends of spindles 15$a_1$', 15$a_1$" by changing the combined length. At its one end spindle 15$a_1$" is connected with beam 14, and spindle 15$a_1$' is connected at its one end with tip lath 11. When fine control of tip lath 11 is performed by the second actuators 13$a_1$, 13$a_2$ . . . , beam 14 hereby remains in the standard position and only tip lath 11 is bent. The first actuators 12$a_1$, 12$a_2$ . . . hereby keep beam 14 in a certain exact position.

For example, in fiber orientation control beam 14 is bent by the first actuators 12$a_1$, 12$a_2$ . . . and the bent shape given to the beam is passed on through the spindles 15$a_1$, 15$a_2$ . . . of the second actuators 13$a_1$, 13$a_2$ . . . of tip lath 11 or through similar parts. Thus, tip lath 11 can be controlled as desired by bending it along its entire length.

In FIG. 2 the distance between the first actuators 12$a_1$, 12$a_2$ . . . is $S_1$, and the distance between the second actuators 13$a_1$, 13$a_2$ . . . is $S_2$ $S_1 > S_2$, that is, the first actuators 12$a_1$ , 12$a_2$ . . . are located with a less close division than the second actuators 13$a_1$, 13$a_2$ . . . Under these circumstances, the second actuators $13a_1$, $13a_2$ . . . are located with a closer division than the first actuators $12a_1$ , $12a_2$ . . . In the embodiment shown in the figure, the top lip beam $K_{10}$ is fixed and does not include any tilting joint for the top lip beam $K_{10}$.

Figure 3A:
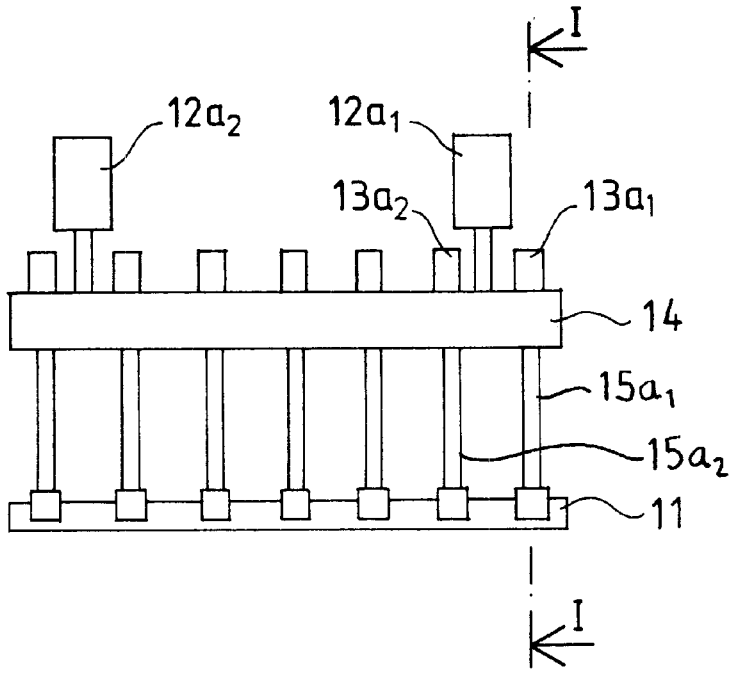
FIG. 3A shows an embodiment of the invention, wherein the second actuators are mounted into the top front surface of a flexible beam and their spindles are mounted through the said beam and are attached to the tip lath.

FIG. 3A shows an embodiment of the invention, wherein the second actuators $13a_1$, $13a_2$ . . . are mounted on to the top front face of intermediate part 14, preferably a bendable beam. Each actuator $13a_1$, $13a_2$ . . . can be used to affect a separate fine control spindle $15a_1$, $15a_2$ . . . and further to affect tip lath 11. The fine control spindles $15a_1$, $15a_2$ . . . are located through beam 14 and further at their one end to connect with tip lath 11. The first actuators $12a_1$ , $12a_2$ . . . are also located to connect with the bendable intermediate part 14, preferably a beam, in between stop face R' and intermediate part 14.

Figure 3B:
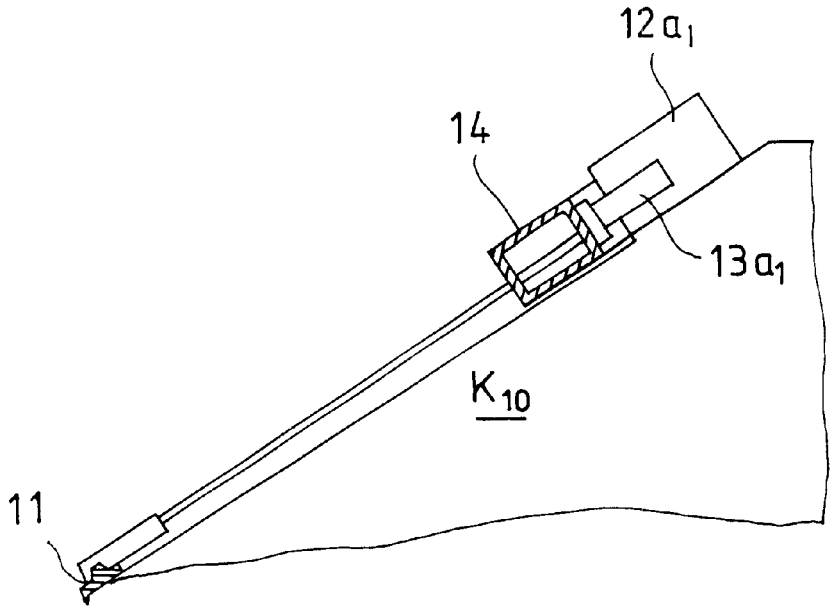
FIG. 3B is a sectional view along the line I—I of FIG. 3A.

FIG. 3B shows a sectional view along line I—I of FIG. 3A.

Figure 4A:
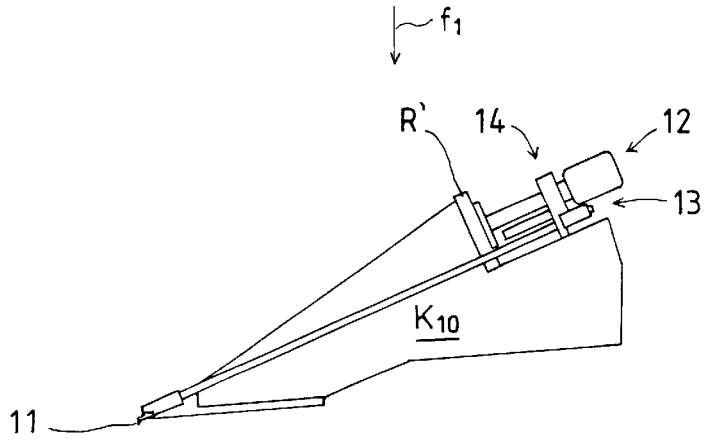
FIG. 4A shows an embodiment of the invention, wherein the first actuators are joined to the top front surface of the flexible beam and also the second actuators are joined to the top front surface of the said flexible beam.

FIG. 4A shows an embodiment of the invention, wherein the stop face R' of the first actuators $12a_1$ , $12a_2$ . . . is located below the first and second actuators $12a_1$, $12a_2$ . . . ; $13a_1$, $13a_2$ . . . The first actuators $12a_1$, $12a_2$ . . . affect between the said stop face R' and the flexible intermediate part 14, preferably a beam extending across the width of the headbox, and correspondingly the second actuators $13a_1$, $13a_2$ . . . affect between the said intermediate part 14 and tip lath 11. In the embodiment, the second actuators $13a_1$, $13a_2$ . . . connect with the top front face of the intermediate part 14, preferably a beam, as do the first actuators $12a_1$, $12a_2$ . . . The spindles of the first actuators $12a_1$, $12a_2$ . . . are located through beam 14 to be attached to stop face R'. Likewise, the spindles of the second actuators $13a_1$, $13a_2$ . . . are located through beam 14 to be attached to tip lath 11.

Figure 4B:
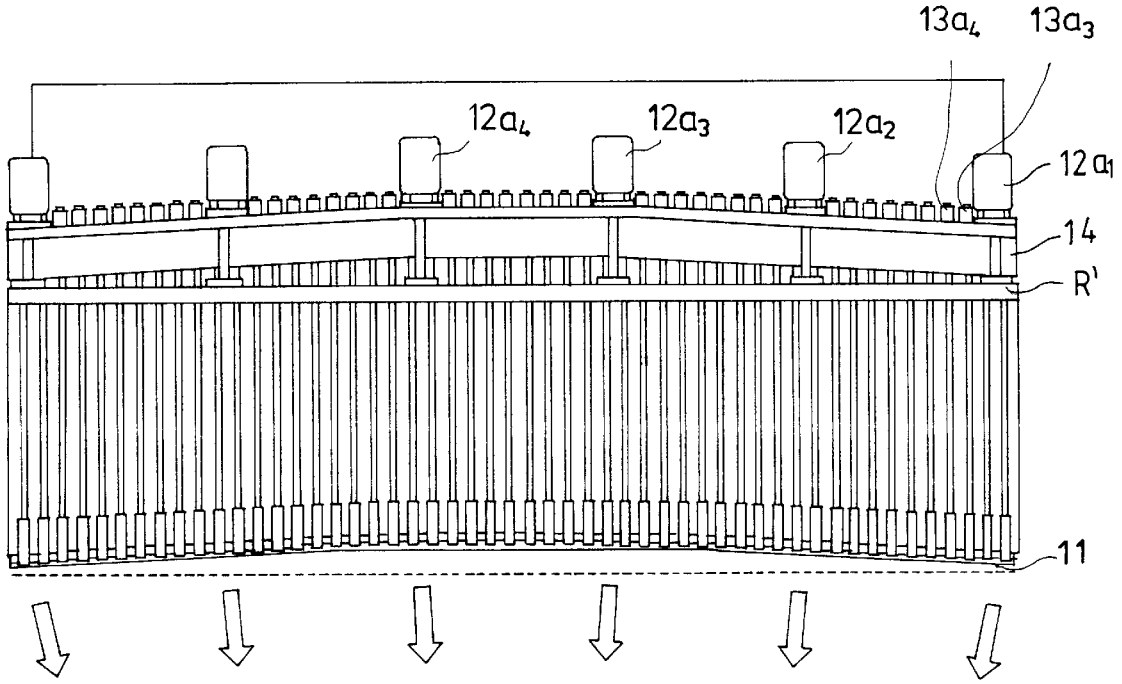
FIG. 4B is a view of the equipment solution in the direction of arrow $f_1$ of FIG. 4A, that is, from above.

FIG. 4B is a view from above of a structure in the direction of arrow $f_1$ of FIG. 4A.

It is understood that the invention is not limited to the particular construction and arrangement of parts herein illustrated and described, but embraces such modified forms thereof as come within the scope of the following claims.

We claim:

1. Control equipment for a headbox tip lath of a paper macine, comprising:

a plurality of first actuators, which are located over a width of a headbox and which connect functionally with a bendable intermediate part, the plurality of first actuators comprising at least one first actuator positioned in a cross machine direction spaced between two first actuators; and a plurality of second actuators, which are used for controlling the tip lath over the headbox width and which connect functionally with the bendable intermediate part and with the tip lath, and that with the aid of the first actuators rough control of the tip lath is carried out and with the aid of the said second actuators fine control of the tip lath is carried out.

2. The control equipment for a headbox tip lath of a paper machine of claim 1 wherein the bendable intermediate part is a beam which extends over the width of the headbox, and wherein the first actuators are spaced a first distance apart in a cross machine direction, and the second actuators are spaced a second distance apart in the cross machine direction, the second distance being less than the first distance.

3. The control equipment for a headbox tip lath of a paper machine of claim 1 wherein the second actuators comprise fine control spindles, the length of which can be controlled.

4. The control equipment for a headbox tip lath of a paper machine of claim 1 wherein the first actuators are located between a fixed stop face and the bendable intermediate part, and wherein the second actuators are located between and connected to both the intermediate part and the tip lath.

5. The control equipment for a headbox tip lath of a paper machine of claim 1 wherein each of the first actuators comprises an electric motor which through a gear moves a spindle which is connected to the intermediate part.

6. The control equipment for a headbox tip lath of a paper machine of claim 5 wherein each first actuator spindle is joined through a gearbox and motor to a fixed stop face of a fame.

7. The control equipment for a headbox tip lath of a paper machine of claim 1 wherein the first and second actuators are located on a top surface of a top lip beam of a lip cone of a headbox in the paper machine.

8. The control equipment for a headbox tip lath of a paper machine of claim 1 wherein the control equipment forms a part of a headbox including a slice having a fixed top lip beam, and wherein the control mechanism is fixed to the headbox, the top lip beam having no joint for opening a lip cone.

9. Control equipment for a headbox tip lath of a paper machine, comprising:

a plurality of first actuators, which are located over a width of a headbox and which connect functionally with a bendable intermediate part; and a plurality of second actuators, which are used for controlling the tip lath over the headbox width and which connect functionally with the bendable intermediate part and with the tip lath, and that with the aid of the first actuators rough control of the tip lath is carried out and with the aid of the said second actuators fine control of the tip lath is carried out, wherein the bendable intermediate part has a top front face, and wherein the second actuators are mounted to the front face such that portions of the second actuators extend through the bendable intermediate part to be connected to the tip lath.

10. Control equipment for a headbox tip lath of a paper machine, comprising:

a plurality of first actuators, which are located over a width of a headbox and which connect functionally with a bendable intermediate part; and a plurality of second actuators, which are used for controlling the tip lath over the headbox width and which connect functionally with the bendable intermediate part and with the tip lath, and that with the aid of the first actuators rough control of the tip lath is carried out and with the aid of the said second actuators fine control of the tip lath is carried out, wherein the first actuators arc connected with the bendable intermediate part and with a stop face which is located in between the intermediate part and the tip lath and below the intermediate part.

11. A method for controlling a tip lath of a headbox in a paper machine, the headbox having a plurality of first actuators spaced in the cross machine direction over a width, the first actuators extending between a stop face, and a bendable intermediate part, the plurality of first actuators comprising at least one first actuator positioned in a cross machine direction spaced between two first actuators, and the headbox having a plurality of second actuators spaced in the cross machine direction over the width, the second actuators extending between the bendable intermediate part and the tip lath, comprising the steps of:

actuating the first actuators to perform rough control of the tip lath; and actuating the second actuators to perform fine control of the tip lath.

12. The method of claim 11 wherein the second actuators comprise fine control spindles connected to the tip lath, and wherein the acuating of the first actuators affects the bendable intermediate part which extends over the headbox width, in such a way that the bent shape is transferred further from the intermediate part through the second actuators to the tip lath, and that the fine control proper of the tip lath is performed by the second actuators.

13. A paper machine headbox, comprising:

a slice extending in a cross machine direction a first width, the slice having a top lip beam;

a frame fixed with respect to the top lip beam and extending the first width;

a plurality of first actuators mounted to the fame and spaced from one another in the cross machine direction, the plurality of first actuators comprising at least one first actuator positioned in a cross machine direction spaced between two first actuators;

a bendable intermediate beam to which each first actuator is connected;

a plurality of second actuators, connected to the intermediate beam; and a tip lath extending the first width, wherein the second actuators extend between the intermediate beam and the tip lath, the first actuators being adjustable for rough control of the tip lath, and the second actuators being adjustable for fine control of the tip lath.

14. The paper machine headbox claim 13 wherein the bendable intermediate beam extends over the width of the headbox, and wherein the first actuators are spaced a first distance apart in a cross machine direction, and the second actuators are spaced a second distance apart in the cross machine direction, the second distance being less than the first distance.

15. The paper machine headbox of claim 13 wherein the second actuators comprise fine control spindles, the length of which can be controlled.

16. The paper machine headbox of claim 13 wherein the first actuators are located between a stop face fixed to the frame and the bendable intermediate beam, and wherein the second actuators are located between and connected to both the intermediate bendable beam and the tip lath.

17. The paper machine headbox of claim 13 wherein each of the first actuators comprises an electric motor which through a gear moves a spindle which is connected to the intermediate part.

18. The paper machine headbox of claim 17 wherein each first actuator spindle is joined through a gearbox and motor to the fixed stop face of the frame.

19. A paper machine headbox, comprising:

a slice extending in a cross machine direction a first width, the slice having a top lip beam;

a frame fixed with respect to the top lip beam and extending the first width;

a plurality of first actuators mounted to the frame and spaced from one another in the cross machine direction, a bendable intermediate beam to which each first actuator is connected;

a plurality of second actuators, connected to the intermediate beam, and a tip lath extending the first width, wherein the second actuators extend between the intermediate beam and the tip lath, the first actuators being adjustable for rough control of the tip lath, and the second actuators being adjustable for fine control of the tip lath, wherein the bendable intermediate part has a top front face, and wherein the second actuators are mounted to the front face such that portions of the second actuators extend through the bendable intermediate part to be connected to the tip lath.

20. A paper machine headbox, comprising:

a slice extending in a cross machine direction a first width, the slice having a top lip beam;

a frame fixed with respect to the top lip beam and extending the first width;

a plurality of first actuators mounted to the frame and spaced from one another in the cross machine direction, a bendable intermediate beam to which each first actuator is connected;

a plurality of second actuators, connected to the intermediate beam, and a tip lath extending the first width, wherein the second actuators extend between the intermediate beam and the tip lath, the first actuators being adjustable for rough control of the tip lath, and the second actuators being adjustable for fine control of the tip lath, wherein the first actuators are connected with the bendable intermediate part and with a stop face connected to the frame and which is located in between the intermediate beam and the tip lath and below the intermediate beam.

* * * * *